US009769905B2

(12) United States Patent
Van De Sluis et al.

(10) Patent No.: US 9,769,905 B2
(45) Date of Patent: Sep. 19, 2017

(54) LIGHTING FIXTURES WITH ADJUSTABLE OUTPUT BASED ON SPATIAL ORIENTATION

(71) Applicant: PHILIPS LIGHTING HOLDING B.V., Eindhoven (NL)

(72) Inventors: Bartel Marinus Van De Sluis, Eindhoven (NL); Tim Berga, Eindhoven (NL); Bram Knappen, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/032,362

(22) PCT Filed: Oct. 15, 2014

(86) PCT No.: PCT/IB2014/065331

§ 371 (c)(1),
(2) Date: Apr. 27, 2016

(87) PCT Pub. No.: WO2015/063640

PCT Pub. Date: May 7, 2015

(65) Prior Publication Data

US 2016/0278184 A1 Sep. 22, 2016

Related U.S. Application Data

(60) Provisional application No. 61/896,245, filed on Oct. 28, 2013.

(51) Int. Cl.
*H05B 37/02* (2006.01)
*H05B 33/08* (2006.01)
(Continued)

(52) U.S. Cl.
CPC ..... *H05B 37/0227* (2013.01); *F21V 21/30* (2013.01); *F21V 21/34* (2013.01);
(Continued)

(58) Field of Classification Search
CPC ..... H05B 33/0845; H05B 33/0854; H05B 37/0227; H05B 37/0245; F21V 21/30; F21V 21/34
(Continued)

(56) References Cited

U.S. PATENT DOCUMENTS 5,662,411 A * 9/1997 Haslam ..... F21V 23/0442 250/353
6,016,038 A 1/2000 Mueller et al.
(Continued)

FOREIGN PATENT DOCUMENTS

| | | | |
|---|---|---|---|
| EP | 2518398 | A2 | 10/2012 |
| WO | 2009126279 | A1 | 10/2009 |
| WO | 2012032452 | A1 | 3/2012 |

*Primary Examiner* — Tung X Le
(74) *Attorney, Agent, or Firm* — Meenakshy Chakravorty

(57) ABSTRACT

Disclosed is a lighting unit (14*a, b*) that includes a housing that can be rotated around an axis. Each lighting unit has at least one light source (16*a,b*/18*a,b*) mounted on the housing, and the intensity of light emitted from the light source is adjustable. The lighting units also have a sensor (540*a, b*) that determines the orientation of the housing relative to a predetermined source Light source Light source Light source mined datum, such as gravity, in response to the rotation of the housing around the axis. The lighting units further have a controller (500*a, b*) connected to the sensor and the light source which automatically adjusts the intensity of light emitted from the light source based upon the determined orientation of the housing.

19 Claims, 10 Drawing Sheets

(51) Int. Cl.

| | |
|---|---|
| ***F21V 29/70*** | (2015.01) |
| ***F21V 21/30*** | (2006.01) |
| ***F21V 21/34*** | (2006.01) |
| *F21Y 101/02* | (2006.01) |
| *F21Y 101/00* | (2016.01) |

(52) U.S. Cl.
CPC ..... *F21V 29/70* (2015.01); *H05B 33/0845* (2013.01); *H05B 33/0854* (2013.01); *H05B 37/0245* (2013.01); *F21Y 2101/00* (2013.01); *F21Y 2101/02* (2013.01)

(58) Field of Classification Search
USPC ..... 315/152; 362/235
See application file for complete search history.

(56) References Cited

U.S. PATENT DOCUMENTS

| | | | | |
|---|---|---|---|---|
| 6,211,626 | B1 | 4/2001 | Lys et al. | |
| 7,014,336 | B1 | 3/2006 | Ducharme et al. | |
| 8,154,780 | B2 * | 4/2012 | Cable | G03H 1/22 359/11 |
| 8,872,432 | B2 * | 10/2014 | Kercso | H05B 37/0227 315/152 |
| 2007/0195526 | A1 | 8/2007 | Dowling et al. | |
| 2009/0231855 | A1 | 9/2009 | Esakoff et al. | |
| 2009/0325644 | A1 * | 12/2009 | Tseng | H04M 1/0202 455/566 |
| 2012/0206050 | A1 * | 8/2012 | Spero | B60Q 1/04 315/152 |
| 2013/0154505 | A1 | 6/2013 | Ren et al. | |
| 2014/0217906 | A1 * | 8/2014 | Vo | H05B 37/0272 315/155 |

* cited by examiner

LIGHTING FIXTURES WITH ADJUSTABLE OUTPUT BASED ON SPATIAL ORIENTATION

CROSS-REFERENCE TO PRIOR APPLICATIONS

This application is the U.S. National Phase application under 35 U.S.C. §371 of International Application No. PCT/IB2014/065331, filed on Oct. 15, 2014, which claims the benefit of U.S. Provisional Patent Application No. 61/896,245, filed on Oct. 28, 2013. These applications are hereby incorporated by reference herein.

TECHNICAL FIELD

The present invention relates generally to lighting fixtures. More particularly, various inventive methods and apparatus disclosed herein relate to lighting fixtures having light property control features based on spatial orientation.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038; 6,211,626, and 7,014,336, incorporated herein by reference.

Lighting fixtures incorporating multiple light sources, such as, for example, LEDs that direct light across a wall surface, and which are rotatable to permit the angle at which the light beam impinges the wall's surface, are generally known in the art. In such lighting fixtures, absent an ability to adjust the intensity of the light emitted from each light source, the smaller the angle at which the light is directed at the surface, the brighter the lighting effect on the wall surface, and conversely the greater the angle of the light source relative to the wall surface, the dimmer the light will appear against the wall. Such lighting effects produce undesirable/aesthetically displeasing bright and dim spots, while wasting energy in providing light at high intensity where it is unnecessary.

Thus, there is a need in the art to provide lighting fixtures that provide an ability to adjust the intensity of emitted light based on selective adjustment of the spatial orientation of the light sources within such lighting fixtures.

SUMMARY

Various inventive methods and apparatus disclosed herein relate to adjusting a property of light emitted from a lighting fixture, such as the light's intensity, based on the spatial orientation of the lighting fixture and/or the light sources within that lighting fixture. For example, in some embodiments, a lighting fixture includes selectively adjustable light sources, wherein a sensor associated with the light sources senses the movement of the light sources and communicates with a controller to adjust the intensity of light emitted from each light source in a manner that corresponds with the orientation of that light source. Such an approach enables user-configurable lighting effects to be created through the manual position readjustment of the individual light sources or lighting units.

Generally, in one aspect, the invention relates to a lighting unit including a housing rotatable around a first axis, a light source mounted on the housing where the intensity of light emitted from the light source is adjustable, a sensor configured to determine the orientation of the housing relative to a predetermined datum, and a controller operably connected between the sensor and the light source, wherein the controller is configured to automatically adjust the intensity of light emitted from the light source based upon the determined orientation of the housing.

In some embodiments, the lighting unit further includes a light source driver operably connected to the controller and the light source.

In some embodiments, the sensor is an accelerometer and the predetermined datum is a gravitational field, or the sensor can be an optical sensor or a magnetic sensor.

In some embodiments, the lighting unit further includes a heat sink mounted to the housing and operably connected to the light source.

In some embodiments, the light sources include an optical element.

In some embodiments, the lighting unit comprises a first light source and a second light source mounted at an angle with respect to each other on the housing.

In some embodiments, the intensity of light emitted by the first light source is stronger than the intensity of light emitted by the second light source when the housing is in a first orientation. Conversely, the intensity of light emitted by the first light source is weaker than the intensity of light emitted by the second light source when the housing is in a second orientation.

In various embodiments of this aspect of the invention, one or more of the light sources may be an LED-based light source, comprising one or more LEDs, including an array of LEDs in a linear, two-dimensional, or three-dimensional configuration.

Generally, in another aspect, the invention relates to a lighting fixture including a rail extending along a longitudinal axis, and a plurality of lighting units mounted to the rail for selective rotation about the longitudinal axis, wherein each of the plurality of lighting units includes a housing, at least one light source, a sensor configured to determine the orientation of the housing relative to a predetermined datum, and a controller that is operably connected between the sensor and the light source. The controller is configured to automatically adjust a predetermined property of the one light sources based upon the determined orientation of the lighting unit.

In some embodiments, each of the plurality of lighting units is independently rotatable about the longitudinal axis.

In some embodiments, each of the plurality of lighting units further includes a light source driver operably connected between the controller and the at least one light source.

In some embodiments, the light source comprises a first light source and a second light source which are mounted on said housing at an angle with respect to each other. In a version of embodiments, the intensity of light emitted by the first light source is stronger than the intensity of light emitted by the second light source when the housing is in a first orientation. Similarly, the intensity of light emitted by the first light source is weaker than the intensity of light emitted by the second light source when the housing is in a second orientation.

In some embodiments, the controller is programmed to automatically adjust a predetermined property of one or more light sources in one or more of the lighting units based upon the determined orientation of another lighting unit within the lighting fixture.

In various embodiments of this aspect of the invention, one or more of the light sources may be an LED-based light source, comprising one or more LEDs, including an array of LEDs in a linear, two-dimensional, or three-dimensional configuration.

Generally, in yet another aspect, the invention relates to a method for creating a desired illumination pattern using a lighting fixture including a rail extending along a longitudinal axis and a plurality of lighting units mounted to the rail for independent rotation about the longitudinal axis, each of the plurality of lights having at least one light source. The method comprises the steps of: (i) automatically determining a first orientation of one or more of the plurality of lighting units in response to rotation of the lighting units; and (ii) automatically adjusting the intensity of light emitted from the light source of the rotated lighting units based upon the determined first orientation of the lighting unit.

In some embodiments, the lighting unit has a first light source and a second light source which are mounted on the housing at an angle with respect to each other.

In some embodiments, the step of automatically adjusting the intensity of light emitted from the light sources of rotated lighting units comprises the step of increasing the intensity of light emitted by the first light source and lowering the intensity of light emitted by the second light source.

In some embodiments, the method further comprises the steps of automatically determining a second orientation of rotated lighting units in response to a second rotation, and automatically re-adjusting the intensity of light emitted from the rotated lighting units based upon the determined second orientation.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs.

The terms "light-emitting element" and "light source" are used interchangeably herein and should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths).

It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K. (typically considered the first visible to the human eye) to over 10,000 degrees K.; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K., a conventional incandescent bulb has a color temperature of approximately 2848 degrees K., early morning daylight has a color temperature of approximately 3,000 degrees K., and overcast midday skies have a color temperature of approximately 10,000 degrees K. A color image viewed under white light having a color temperature of approximately 3,000 degree K. has a relatively reddish tone, whereas the same color image viewed under white light having a color temperature of approximately 10,000 degrees K. has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A potentiometer (variable resistor) is another non-limiting example of a "controller" as used herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), potentiometers, and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "datum" as used herein shall refer a position, point, level, or other standard from which measurements and/or orientation are taken or determined.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Applicants have recognized and appreciated that it would be beneficial to adjust light intensity based upon the orientation of light sources relative to a predetermined datum.

In view of the foregoing, various embodiments and implementations of the present invention are directed to a lighting fixture having selectively adjustable light sources, wherein a sensor associated with the light sources senses the movement of the light sources and communicates with a controller to adjust the intensity of light emitted from each light source in a manner that corresponds with the orientation of the light source. While the description of the various embodiments/aspects of the invention relate to generally rotatable lighting fixtures, applications can extend to advanced lighting infrastructures where a plurality of rotatable light sources are used to illuminate segments of various heights, such as, for example, architectural lighting on building facades.

Figure 1A:
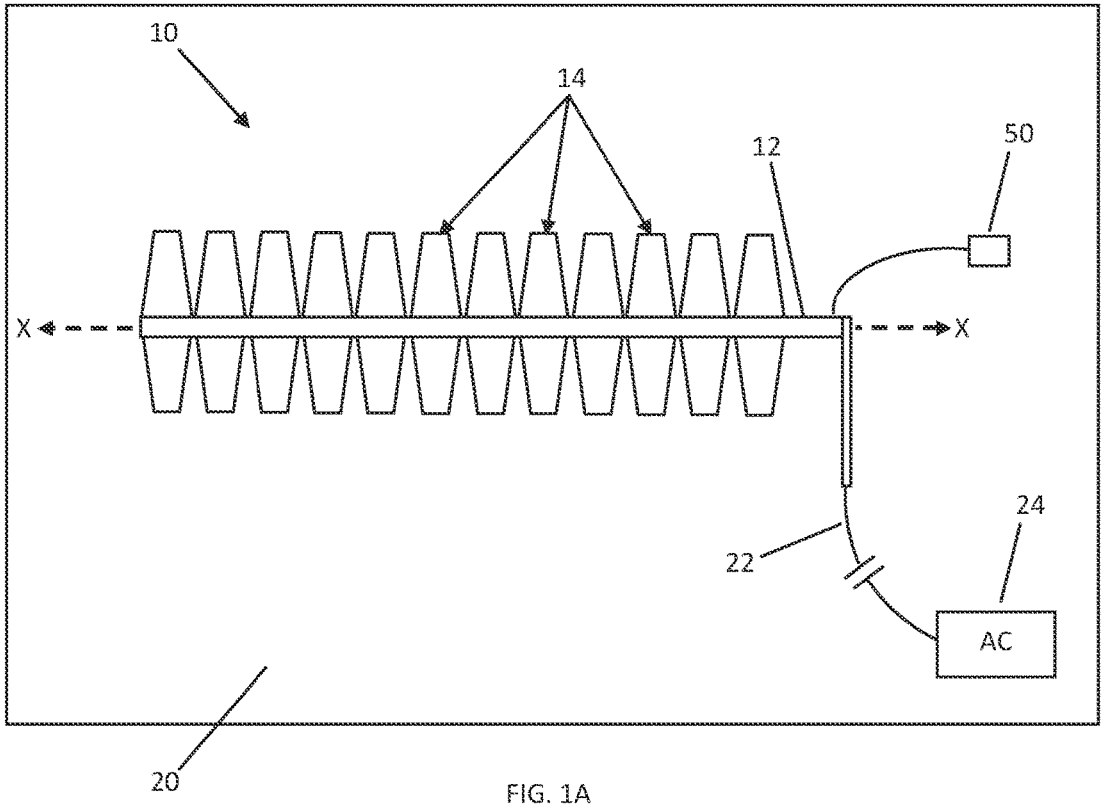
FIGS. 1A-1C are a front elevation schematic representations of a lighting fixture in accordance with an embodiment of the invention.

Referring now to the drawings, in FIG. 1A there is shown one embodiment of a lighting fixture, designated generally by reference numeral 10, having an elongated rail 12 that extends along a longitudinal axis X-X and to which a plurality of lighting units 14 are mounted for rotation about axis X-X. In this embodiment each lighting unit 14 generally includes at least a pair of light sources 16 and 18 (shown in, for example, FIG. 2) operably mounted therein and arranged at an angle with respect to each other in order to direct light in different, preferably at least partially non-overlapping, directions. For example, if rail 12 is mounted to a wall 20 along a horizontally extending axis X-X, light source 16 directs light above rail 12, while light source 18 directs light below rail 12. According to another embodiment, lighting unit 14 may contain any number of light sources, including as little as one light source and as many as hundreds or more depending on the application of the lighting fixture.

Rail 12 can include a power transmission medium 22, such as cable/wires, disposed therein or therealong and operably attached to a source of power 24, most typically AC power. Power transmission medium 22 operably connects to each lighting unit 14 in series to provide power to the light sources 16 and 18.

According to one aspect, a switch 50 can be mounted along and/or adjacent to rail 12 for purposes of providing power or eliminating power to lighting units 14, as shown in FIG. 1A. In another aspect of the invention, no dedicated switch is provided for providing power to light fixtures 14, but rather power is eliminated from each lighting unit 14 when it is put in its neutral (or 0° relative to the Z-axis, or some other possible axis or orientation) position. Manually rotating the lighting unit 14 will cause power to be delivered thereto with the intensity of light emitted being dictated by the lighting unit's relative position.

In one embodiment as reflected in FIGS. 2 and 3A-C, lighting unit 14 has an elongated housing 26 that extends along a longitudinal axis Y-Y. Housing 26 is defined by two elongated sections 28 and 30 that are separated at about the midpoint by one or more housing mounts 32 that are attached to the housing and serve to attach each lighting unit 14 to rail 12 and allow for rotation. For example, housing mount 32 can be one or more brackets that define an opening for rail 12. According to an embodiment, the elongated sections 28 and 30 can be generally U-shaped in cross-section in order to direct the light emitted by light sources 16 and 18. While lighting unit 14 can be generally U-shaped in cross-section, it should be understood that other shapes could be employed as well.

Figure 2:
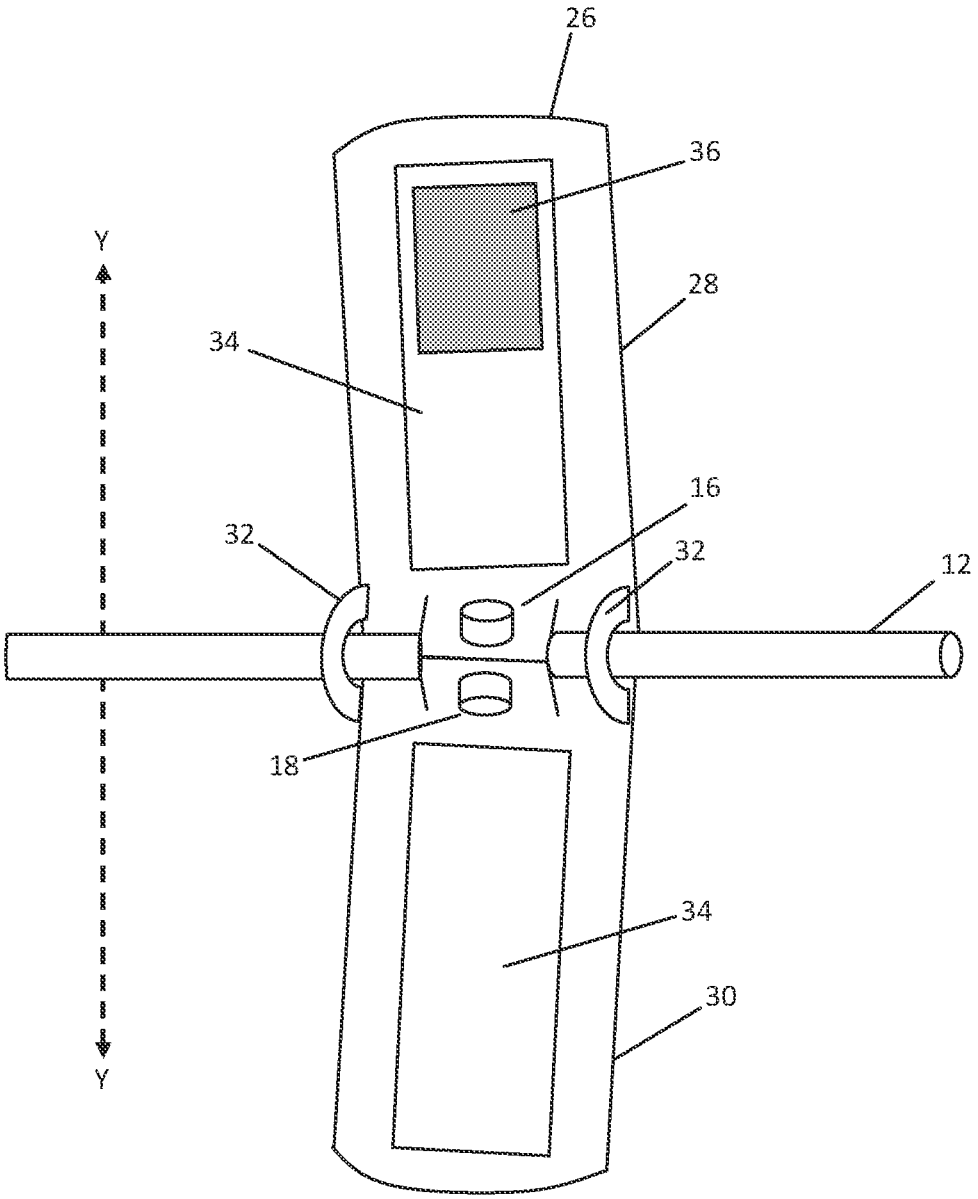
FIG. 2 is a perspective view of a lighting unit in accordance with an embodiment of the present invention.

In some embodiments, lighting unit 14 includes a plurality of light sources, such as light sources 16 and 18 as shown in FIG. 2. For example, one or more of the light sources may be an LED-based light source. Further, the LED-based light source may have one or more LEDs, including an array of LEDs in a linear, two-dimensional, or three-dimensional configuration. The light source can be driven to emit light having predetermined attributes (i.e, color intensity, color temperature, etc.). Many different numbers and various types of light sources (all LED-based light sources, LED-based and non-LED-based light sources alone or in combination, etc.) adapted to generate radiation of a variety of different colors may be employed in the lighting unit 14. For example, in some embodiments, lighting unit 14 includes LEDs of two or more different colors. Accordingly, spatial orientation of the lighting units described herein may also result in adjustment of the color or color temperature of emitted light.

According to an embodiment, housing mount 32 has an annular opening through which rail 12 may frictionally pass, and preferably includes a rubber or other frictional coating that permits both selective rotation of lighting unit 14 about rail 12, but also static, secure fixation of lighting unit 14 when a moving force is not applied thereto. Housing mount 32 and lighting unit 14 could also be designed, for example, such that wherever a user selectively moves the fixture, balance will cause the fixture to remain static until another force is applied thereto.

Lighting unit 14 can further include one or more heat sinks 34 that attach to the interior facing surface of lighting unit 14 and contour all or a portion of the surface of sections 28 and 30, and optionally also housing mount 32. The heat sinks may also function as light reflectors. Heat sink 34 can be operably connected to one or more of light sources 16 and 18.

According to an embodiment, each lighting unit 14 further includes control circuitry 36 that functions to operate one or more light sources. Control circuitry 36 may be implemented with or without employing a processor, and also may be implemented as a combination of dedicated hardware to perform some functions and a processor (e.g., one or more programmed microprocessors and associated circuitry) to perform other functions. For example, control circuitry 36 can be a circuit board that includes one or more of a sensor such as an accelerometer, a microprocessor, a pair of light source drivers such as LED drivers that are operably connected to light sources 16 and 18, and a power source or converter. To control heat, control circuitry 36 can be mounted atop heat sink 34 within either of sections 28 or 30.

Figure 3A:
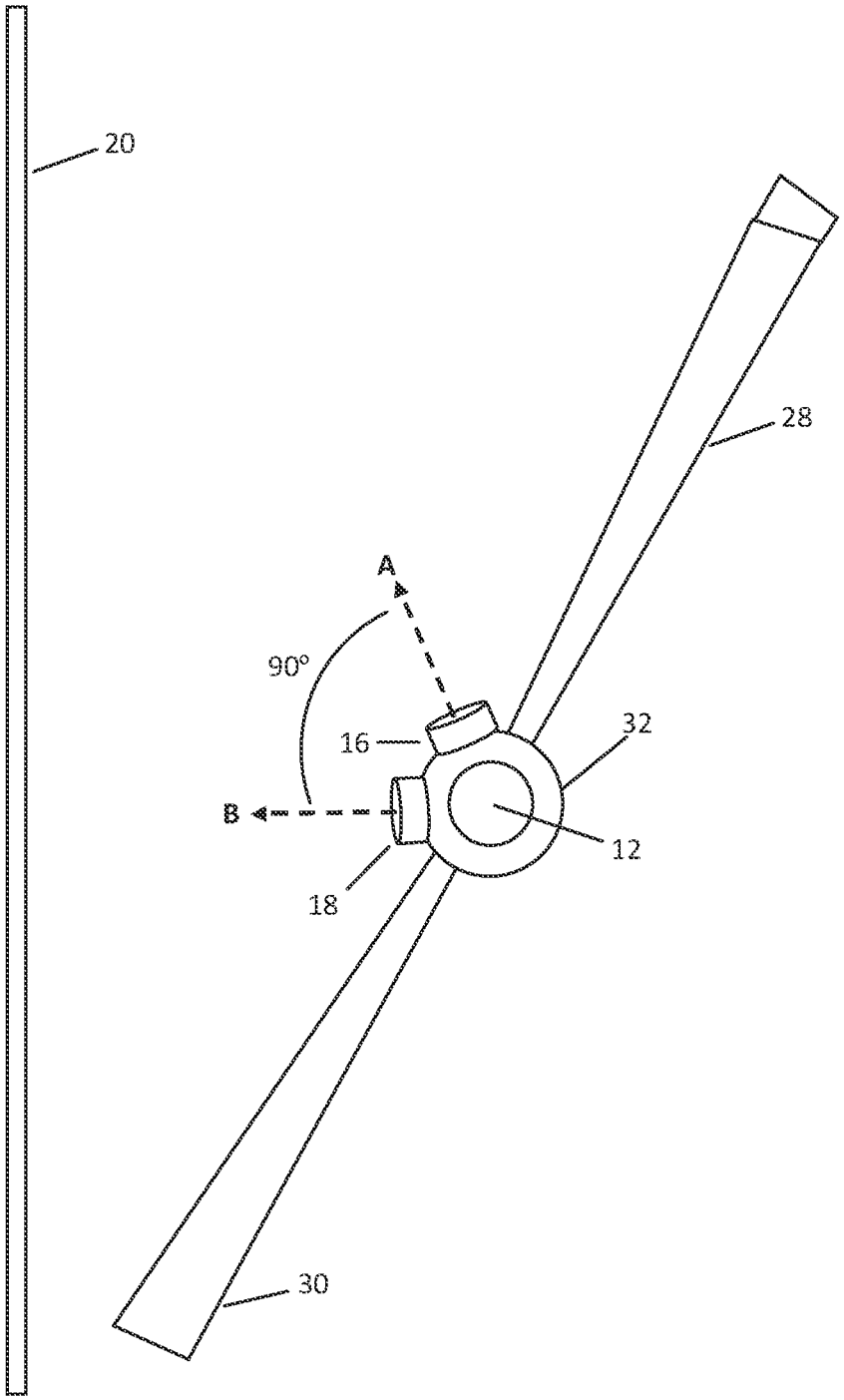
FIGS. 3A-3C are side elevation views of a lighting unit in three different spatial orientations in accordance with an embodiment of the invention.
Figure 3B:
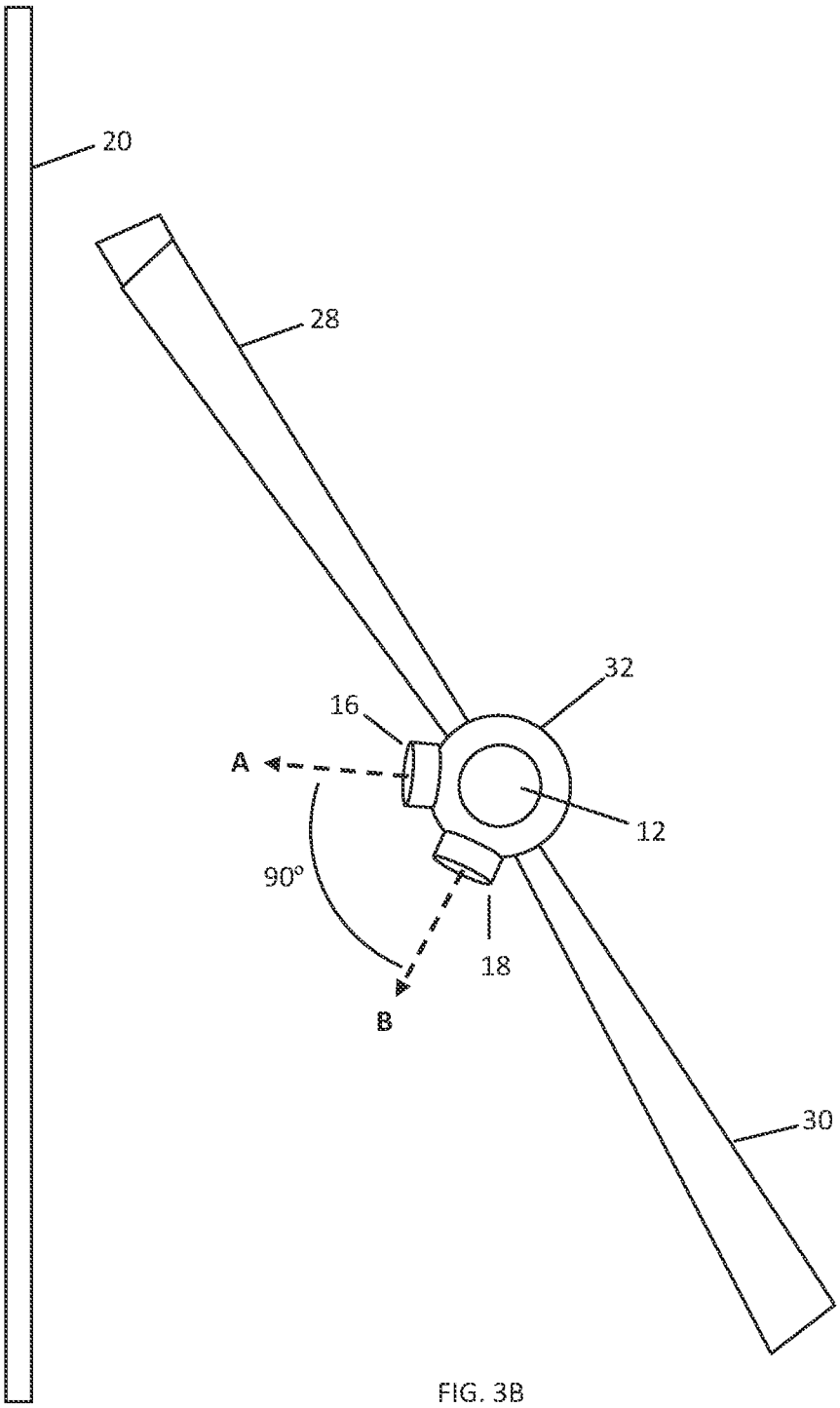

In the disclosed embodiment, the lighting unit provides an up and down (or right and left depending on how rail 12 is mounted to a surface) light guiding/directing function for lighting fixture 10, as shown in FIGS. 3A and 3B. In this embodiment, light sources 16 and 18 are mounted to the housing with optical axes A-A and B-B, respectively, being separated by about a 90 degree angle, although many other angles are possible.

Figure 3C:
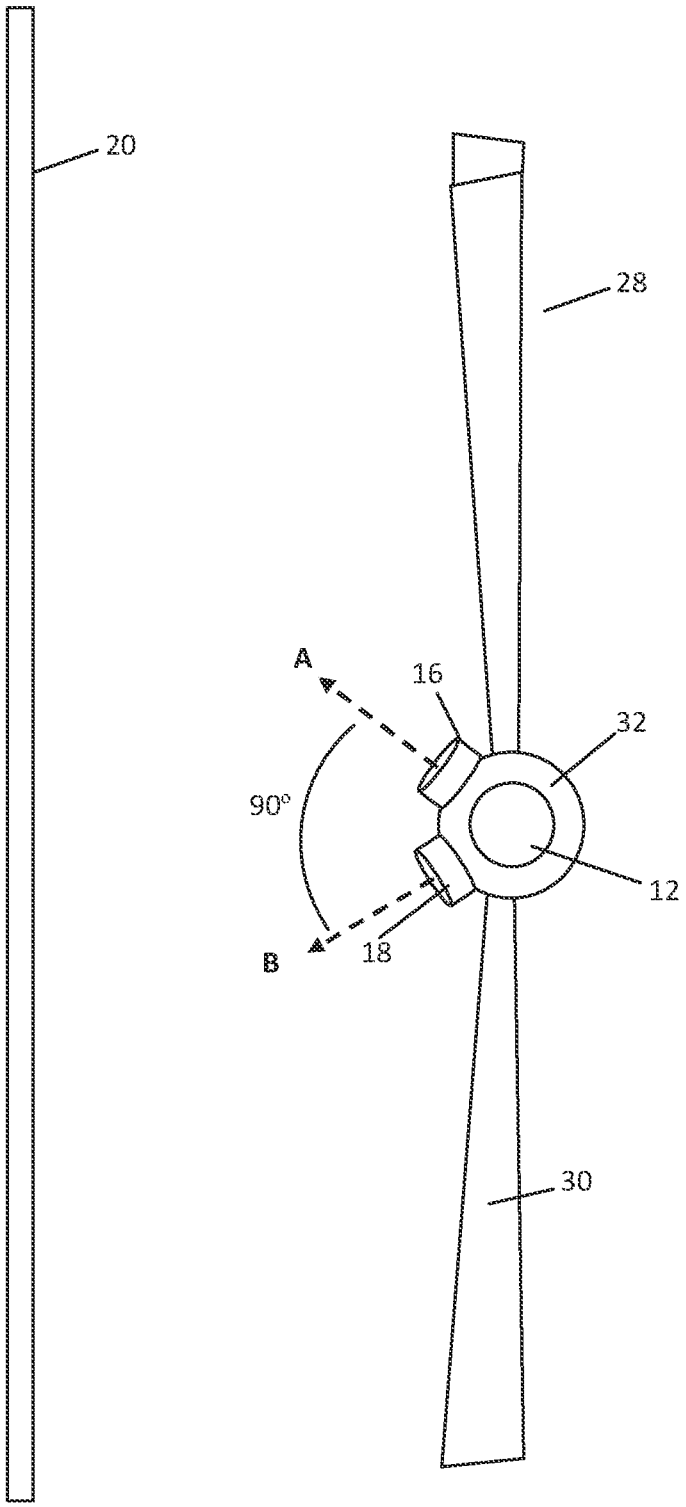

FIGS. 3A-3C also depict how light intensity is adjusted based upon the orientation of lighting unit 14. For example, when the top elongated section 28 of lighting unit 14 is rotated 45° relative to vertical as shown in FIG. 3A, the intensity of light source 18 is low while the intensity of light source 16 is high. Thus, the intensity of light emitted by light source 16 will be stronger than the intensity of light emitted by light source 18 when the housing is positioned in this first orientation. In this example, because light source 18 is directed approximately straight at wall 20, a low intensity will prevent a hot spot (or overly bright spot) from appearing on the wall surface. Accordingly, light source 16 is therefore directed away from wall 20 and by increasing its intensity its light emission will more broadly cover wall 20 with a more uniform lighting.

As another example, when the top elongated section 28 of lighting unit 14 is rotated −45° relative to vertical as shown in FIG. 3B, the intensity of light source 16 will be low while the intensity of light source 18 will be high. Thus, the intensity of light emitted by light source 18 will be stronger than the intensity of light emitted by light source 16 when the housing is positioned in this second orientation. In this example, because light source 16 is directed approximately straight at wall 20, a low intensity will prevent a hot spot (or overly bright spot) from appearing on the wall surface. Accordingly, light source 18 is therefore directed away from wall 20 and by increasing its intensity its light emission will more broadly cover wall 20 with a more uniform lighting.

As yet another example, shown in FIG. 3C, when lighting unit 14 is oriented with both light sources 16 and 18 at 0° angles relative to vertical, each light source 16 and 18 will be provided with low intensity so as to produce a uniform lighting effect on wall 20. It should be understood that the level of intensity associated with any given orientation of lighting unit 14 can be selected based on a desired effect.

Figure 1B:
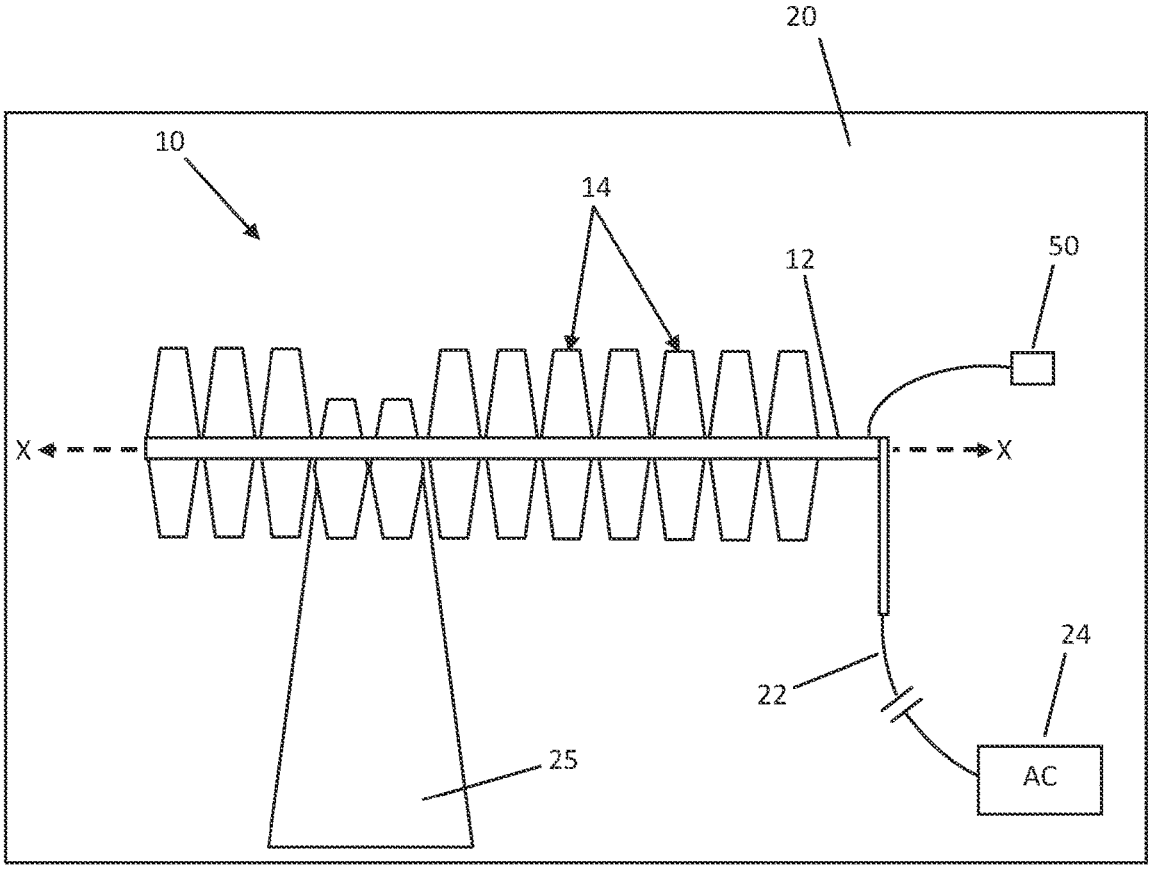
Figure 1C:
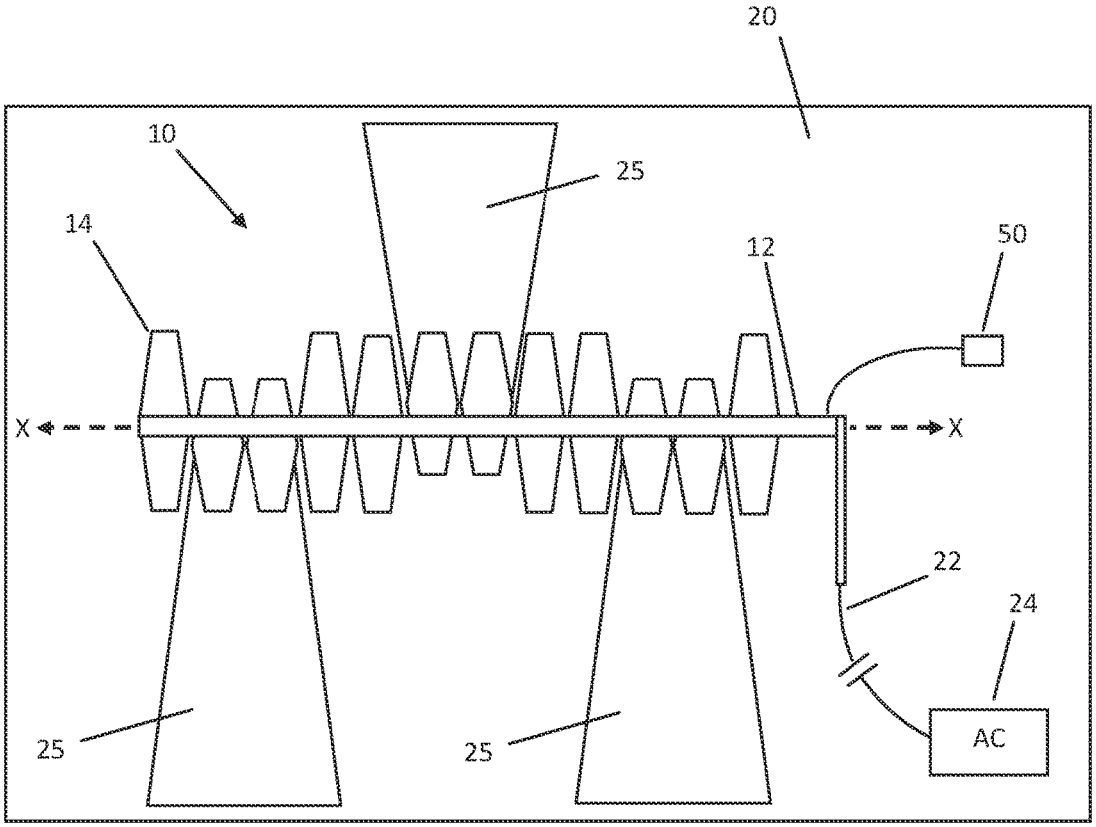

For example, as shown in FIG. 1B, the elongated section 28 of two lighting units are rotated approximately −45° relative to vertical (similar to FIG. 3B), and the intensity of light source 18 of these lighting units is increased, thereby resulting in a beam of light 25 shining downward on wall 20. Similarly, as shown in FIG. 1C, several lighting units at the far right and the far left are rotated approximately −45° relative to vertical (as in FIG. 3B), and several lighting units in the center are rotated approximately 45° relative to vertical (as in FIG. 3A), while the remainder of the lighting units are neutral (as in FIG. 3C). The intensity of the light sources of these rotated lighting units are appropriately strengthened or weakened as described herein. Accordingly, by selective rotation of one of more of the individual lighting units 14, many different illumination patterns can be created.

It should also be understood that the present invention can support a single color of light, or may alternatively include the ability for the user to control the color or color temperature of the generated light effect.

Figure 4:
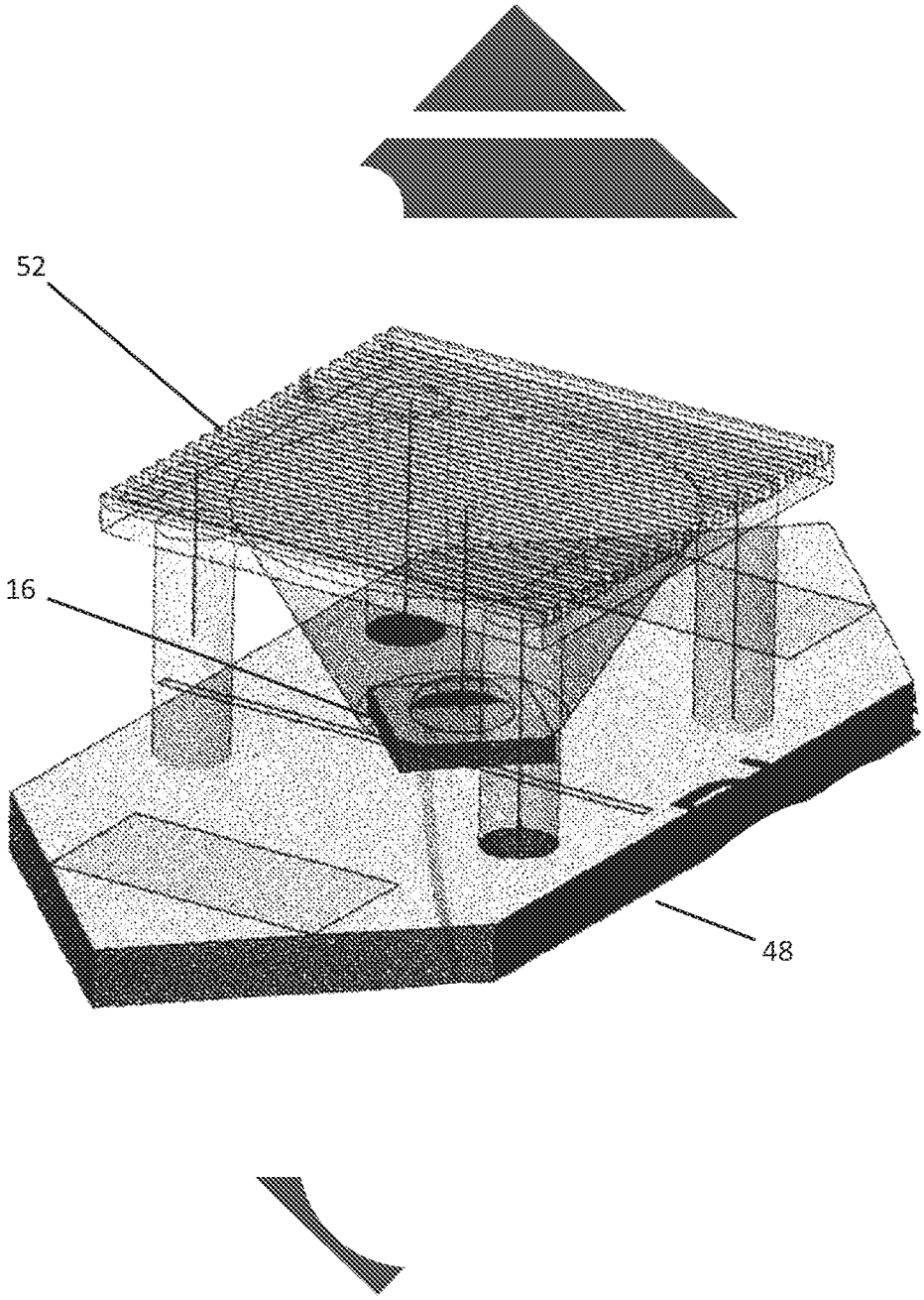
FIG. 4 is a perspective view of a mounted light source and optical element in accordance with an embodiment of the present invention.

In accordance with one embodiment, each light source can be mounted on or within a mount 48, as depicted in FIG. 4. There may be multiple light sources on a single mount, or each light source may have its own mount. For example, light source 16 can be mounted on mount 48, and light source 18 can be mounted on mount 50 (not shown but identical to mount 48). In addition to serving as a mount for the light source, mount 48 can provide staging for an optical element 52, which can be a lens, light diffuser, or other element that provides a desired lighting effect to the light emitted from light sources 16 and 18.

Figure 5:
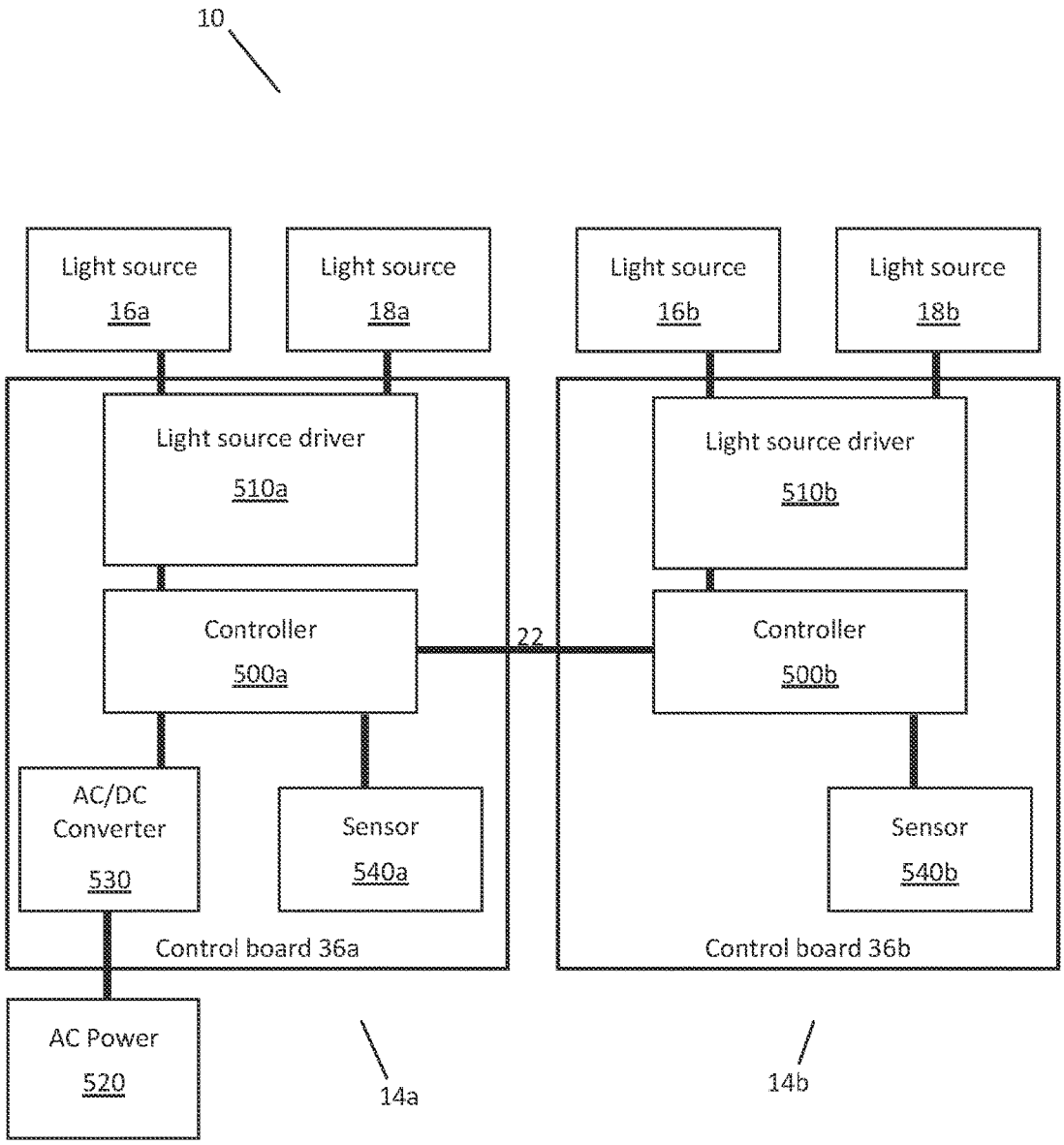
FIG. 5 is a schematic of a lighting fixture in accordance with an embodiment of the invention.

With reference to FIG. 5, each of lighting units 14*a* and 14*b* in lighting fixture 10 include its own control circuitry (36*a* and 36*b*) to provide the lighting unit with an automatically adjusting functionality that is based upon the orientation of lighting unit 14 relative to a predetermined datum including, but not limited to, wall 20, rail 12, Earth's gravitational field, magnetic north, the horizon, and many other reference points. While light intensity is a preferred property to control, other properties could also be controlled, including but not limited to color, color temperature, and the like. According to one embodiment, power source 520 routes to an AC/DC converter 530, and the resulting power is provided to a controller 500*a*, a sensor 540*a*, a light source driver 510*a*, and each of light sources 16*a* and 18*a*.

Sensor 540*a* determines the orientation of the housing of lighting unit 14 relative to a predetermined datum such as a fixed point, a gravitational field, a magnetic field, and a variety of other datum. Controller 500*a* is operably connected between the sensor 540*a* and the light sources 16*a* and 18*a*. Light source driver 510*a* is operably connected to both the controller 500*a* and the light sources 16*a* and 18*a*. Sensor 540*a* can be, for example, a microelectromechanical systems (MEMS) sensor such as an accelerometer that measures the gravitational force on its Z-axis and sends this data to controller 500*a*. Sensor 540*a* may also be, for example, a magnetic field sensor, an optical sensor, or any of a number of other types of sensors. Since lighting unit 14*a* is free to rotate around rail 12, the gravitational force along the Z-axis will change relative to the rotational position of lighting unit 14*a*; thus, by manually or automatically rotating lighting unit 14*a* on rail 12, the gravitational force sensed by sensor 540*a* will change and this value will be passed as an electrical output from sensor 540*a* to controller 500*a*. When controller 500*a* receives the data from sensor 540*a*, it converts this electrical input to an electrical output sent to light source driver 510*a*, which in turn adjusts the intensity of light emitted from light sources 16*a* and/or 18*a*, depending on the angle of lighting unit 14*a*. Alternatively, the control board may include a separate light source driver for each light source. The adjustment of light intensity is achieved in any conventional manner, such as, for example, pulse width modulation (varying the duty cycle of the LED current, pulsed at maximum level, to change the average current in the LED), or controlled current (varying the LED current to directly change the steady-state current in the LED), as well as other methods.

In one embodiment of the invention, as depicted in FIG. 5, lighting fixture 10 includes a plurality of lighting units 14 (14*a* and 14*b*) mounted along rail 12 (not shown). Power is routed from lighting unit 14*a* to lighting unit 14*b* through power transmission medium 22, such as cable or wires that are disposed on or within rail 12. Although only two lighting units are shown in this embodiment, the number of possible lighting units is not limited to two. Further, multiple lighting fixtures can be arranged together to function as a cohesive unit. These multiple lighting fixtures can be physically independent of one another, can be connected over a network by wired communication, or can be in wireless communication with one another. Furthermore, in some embodiments, lighting units 14 can be individually addressable over the network, as described above, to generate coordinated light output of desired pattern or coordinated dynamic lighting effect.

Lighting unit 14*b* includes controller 500*b*, sensor 540*b*, light source driver 510*b*, and each of light sources 16*b* and 18*b*. Similar to lighting unit 14*a*, lighting unit 14*b* is free to rotate around rail 12, at which time the gravitational force along the Z-axis will change relative to the rotational position of lighting unit 14*b*; thus, by manually or automatically rotating lighting unit 14*b* on rail 12, the gravitational force sensed by sensor 540*b* will change and this value will be passed as an electrical output from sensor 540*b* to controller 500*b*. Controller 500*b* will send a signal to light source driver 510*b*, which in turn adjusts the intensity of light emitted from light sources 16*b* and/or 18*b*, depending on the angle of lighting unit 14*b*.

According to one aspect, each lighting unit 14 in a lighting fixture is independent of the others in the respect of having independent control of the light intensities emitted from the light sources within that lighting unit. In another aspect, the controller 500 of each lighting unit is addressable and programmed to know the intensity of light being emitted from each light source of its adjacent lighting units, and can adjust its own intensity accordingly if necessary. Alternatively, adding connectivity to each lighting unit 14, such as power line communications, communications via a wired data bus, wireless RF communication, or light enabled communication such as coded visible or IR light, could also provide the necessary means to permit each lighting unit 14 to know and respond to a light intensity of an adjacent light source.

In some embodiments, for example, the lighting units within a lighting fixture are in communication or are otherwise aware of the light emitted from adjacent lighting units so that the plurality of lighting units can function together. For example, the overall light pattern emitted by lighting fixture 10 can result from coordination of the plurality of lighting units 14 within that lighting fixture. This coordination allows the overall light pattern emitted from lighting fixture 10 to remain constant even when one or more of the lighting units 14 are rotated, turned on or off, or the light emitted by that lighting unit is otherwise modified. As an example, lighting fixture 10 can include four lighting units that are in wired or wireless communication. The four lighting units, for example, can be operably connected to a single controller. Each of the four lighting units transmit to the controller and/or other lighting units information regarding its orientation about the rail 12 and regarding the intensity, color, and other characteristics of the light emitted by that lighting unit. If, for example, one of the four lighting units are rotated, the rotated lighting unit will send information about its new orientation (and/or the change in its orientation) to the other three lighting units or to a central controller, which can then adjust the light emitted by one or more of the four lighting units in such a way as to avoid any change in the intensity, color, or direction of the overall light pattern emitted by lighting fixture 10. Accordingly, the lighting units 14 can be rotated to create any pattern, design, or appearance of the lighting fixture 10 without affecting or altering the overall light pattern emitted by that lighting fixture.

In another aspect of the invention, one or more of the lighting units 14 in lighting fixture 10 includes beveled sidewalls that allow a user to slide their hand or a tool along lighting units 14 mounts to rail 12, from one side to the other, in order to quickly place all the lighting units into the same orientation. This creates a uniform or gradually changing lighting effect with minimal time having to be spent by the user. For example, the sidewalls of each lighting unit can be beveled at 40° to maximize ease of use. According to another embodiment, each lighting unit 14 can be precisely set by a user gripping one or more ends of the lighting unit and rotating it about rail 12 until the desired orientation is reached.

In order to provide power to lighting units 14, power transmission medium 22 can be cables or wires that extend through rail and out of holes formed therein and connect to each lighting unit 14. Alternatively, a pair of electrical contacts may be formed on the interior surface of housing mount 32 and contacting rail 12 that is divided into two halves; the upper half of which serves as an anode and the bottom half of which serves as a cathode. As another alternative, power transmission can be achieved using capacitive power coupling between rail 12 and each lighting unit 14. As yet a further example, power transmission can be accomplished by way of inductive coupling. In all of these aspects except for the dedicated cabling that extends through holes formed through rail 12, each of the power transmission means facilitates the modularity of lighting fixture 10. Any number of lighting units 14 can be added to or taken away without impacting the overall system, the only limiting factor being the length of rail 12.

In regard to sensing the orientation of lighting unit 14, one embodiment includes use of accelerometers the can utilize earth's gravitational field as an orientation axis. This works well when lighting fixture 10 is mounted with rail 12 extending horizontally across a wall 20 as earth's gravity and the surface of the wall are approximately parallel to one another. An alternative orientation sensor can include resistive, optical, or magnetic sensors that are embedded in housing mount 32 or another portion of lighting unit 14 and adapted to measure either relative or absolute rotation around axis X-X. As another alternative, sensing can be performed relative to a surface using sensors that are embedded in the backs of each light source 16 and 18 and which measure the distance between the light sources and the surface the light source is illuminating. In this aspect, the relative angle of the light source to the illuminating surface is also relevant and optical sensors can be used to accomplish this form of sensing. In yet another aspect, sensing can be achieved relative to other lighting units 14. In this aspect, there is communication between adjacent lighting units 14 such that relative positions can be converted into absolute positioning. This relative positioning can be done using optical, magnetic, or galvanic/resistive type sensors. In another aspect, similar to the primary embodiment, sensing can be determined relative to earth's properties. In this aspect, an accelerometer can be used in relation to gravity or a magnetometer may be used in relation to true north, and with an extra calibration step a wall that is not perpendicular or parallel to earth's magnetic field and/or gravity can be used as the mounting surface.

Figure 6:
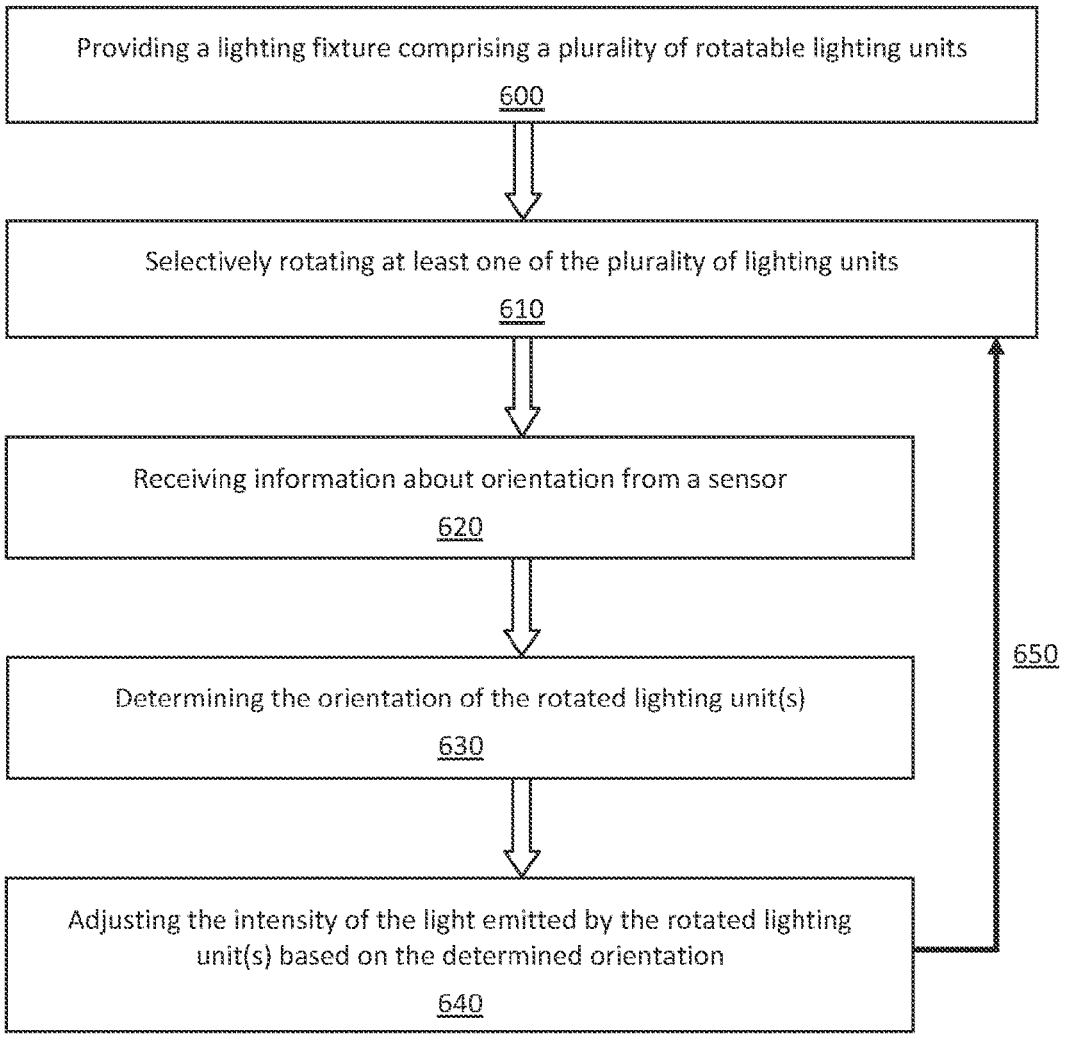
FIG. 6 is a flow chart of a method of adjusting a light source in accordance with an embodiment of the invention.

Referring to FIG. 6, a flow chart illustrating a method for creating a desired illumination pattern in accordance with an embodiment of the invention is disclosed. In step 600, a lighting fixture including a plurality of rotatable lighting units is provided. The lighting fixture can be any of the embodiments described herein or otherwise envisioned. For example, lighting fixture 10 can include an elongated rail 12 that extends along a longitudinal axis X-X and to which a plurality of lighting units 14 are mounted for rotation about the X-X axis. Each lighting unit preferably includes a pair of light sources 16 and 18 operably mounted thereon and arranged to direct light of varying intensities in different, preferably at least partially non-overlapping, directions.

Lighting unit 14 may contain any number of light sources, including as little as one light source and as many as hundreds or more depending on the application of the lighting fixture. For example, one or more of the light sources 16 and 18 may be an LED-based light source. Further, the LED-based light source may have one or more LEDs, including an array of LEDs in a linear, two-dimensional, or three-dimensional configuration. The light source can be driven to emit light of a predetermined character (i.e, color intensity, color temperature, etc.). Many different numbers and various types of light sources (all LED-based light sources, LED-based and non-LED-based light sources alone or in combination, etc.) adapted to generate radiation of a variety of different colors may be employed in the lighting unit 14.

In step 610, at least one of the plurality of lighting units 14 is selectively rotated about rail 12. The lighting unit can be manually rotated by a user, for example, or rotation can be automated. For example, the lighting fixture or each individual lighting unit can include a motor or other rotating mechanism that rotates either the lighting fixture or individual lighting units. As one embodiment, the lighting fixture can be programmed to rotate to one or more certain predetermined orientations at particular times of day, in which case lighting fixture 10 includes a clock or another method to determine the time of day and/or time of year. For example, the lighting fixture can automatically orient itself to a first predetermined orientation in the morning and a second predetermined orientation in the evening. As another embodiment, the lighting fixture can be programmed to rotate to one or more certain predetermined orientations based on ambient light levels, in which case lighting fixture 10 includes an ambient light sensor. For example, the lighting fixture can automatically orient itself to a first predetermined orientation when ambient light levels are high, and can automatically orient itself to a second predetermined orientation when ambient light levels are low.

In step 620, the lighting fixture or individual lighting units receive information about their orientation. After the lighting fixture or individual lighting units are moved from an existing orientation to a second orientation by a user, the new orientation must be determined. According to one embodiment, the new orientation is determined relative to a datum such as a wall, rail 12, Earth's gravitational field, and/or magnetic north, among other reference points. Accordingly, lighting fixture 10 and/or individual lighting units 14 includes one or more sensors 540 that are utilized to determine an orientation characteristic such as gravitational force, optics, or a magnetic field among many other types of detectable characteristics that can be used to determine orientation. Since each lighting unit 14 is free to rotate around rail 12, the gravitational force along the Z-axis of the lighting unit will change relative to the rotational position of the lighting unit. Accordingly, by manually or automatically rotating lighting unit 14 on rail 12, the gravitational force sensed by sensor 540 will change, and this information will be used to determine the orientation of the lighting unit in step 630.

According to an embodiment, the lighting fixture or individual lighting units continually receive information about their orientation from the one or more sensors 540. Alternatively, the lighting fixture or individual lighting units can specifically request data from sensor 540 if an orientation change is detected, or sensor 540 can be programmed to transmit sensor data if there is movement, a change in sensor data above a preprogrammed threshold, or at preprogrammed intermittent periods of time.

In step 630, the new orientation of the lighting fixture or individual lighting units is determined. Lighting unit 14 can include a controller 500 that receives and/or requests sensor data from sensor 540 continually, intermittently, or in response to a preprogrammed event. Controller 500 can be preprogrammed to utilize data from sensor 540 to determine the post-movement orientation of the lighting unit 14. According to an embodiment, controller 500 is a microprocessor preprogrammed to receive the output of the accelerometer and utilize that output to determine orientation. Accelerometers can be sensitive to both linear acceleration and the local gravitational field, and thus can sense provide information about movement as well as the pitch and roll orientation angles of the accelerometer. A three-axis accelerometer, for example, can provide information about x, y, and z axes. The microprocessor can also be programmed to first determine that a movement has occurred based on the detection of linear acceleration by the accelerometer.

As an example, FIGS. 3A-3C depict rotation of a lighting unit 14 about rail 12. When the lighting unit 14 is rotated from any first position to a second position, for example wherein the top elongated section 28 of lighting unit 14 is approximately 45° relative to vertical as depicted in FIG. 3A, linear acceleration is detected by sensor 540 and the sensor provides information about the new orientation to controller 500. Similarly, when lighting unit 14 is rotated from any first position to a second position, for example wherein the top elongated section 28 of lighting unit 14 is approximately −45° relative to vertical as depicted in FIG. 3B, linear acceleration is detected by sensor 540 and the sensor provides information about the new orientation to controller 500. In step 640, the intensity of light source 16 and/or light source 18 of a rotated lighting unit 14 is adjusted based on the orientation that was determined in step 630. FIGS. 3A and 3B provide one embodiment of how light intensity is adjusted based upon the orientation of lighting unit 14. In FIG. 3A for example, when the top elongated section 28 of lighting unit 14 is oriented in a position that is approximately 45° relative to vertical, the intensity of light source 18 is low while the intensity of light source 16 is high. Accordingly, moving lighting unit into this orientation will result in light source 18 to be adjusted from a first intensity to a second, low intensity, and light source 16 will be adjusted from a first intensity to a second, high intensity. Similarly, in FIG. 3B when the top elongated section 28 of lighting unit 14 is oriented in a position that is approximately −45° relative to vertical, the intensity of light source 16 will be low while the intensity of light source 18 will be high.

Accordingly, moving lighting unit into this orientation will result in light source 16 to be adjusted from a first intensity to a second, low intensity, and light source 18 will be adjusted from a first intensity to a second, high intensity.

The adjustment of intensity of light sources 16 and 18 can be achieved in any conventional manner, such as, for example, pulse width modulation (varying the duty cycle of the LED current, pulsed at maximum level, to change the average current in the LED), or controlled current (varying the LED current to directly change the steady-state current in the LED), as well as other methods. In step 650, one or more of the lighting units 14 are again rotated, and steps 620, 630, and 640 are repeated in response to the lighting units adopting a new orientation. If the new orientation is not significantly different from the first orientation such that a predetermined threshold is not met, then no change in light intensity may be warranted.

While several inventive embodiments have been described and illustrated herein, those of ordinary skill in the art will readily envision a variety of other means and/or structures for performing the function and/or obtaining the results and/or one or more of the advantages described herein, and each of such variations is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. In addition, any combination of two or more such features, systems, articles, materials, kits, and/or methods, if not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

Also, reference numerals appearing between parentheses in the claims are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

The invention claimed is:

1. A lighting unit comprising:

a housing rotatable about at least a first axis;

at least one light source mounted on said housing, wherein the intensity of light emitted from said at least one light source is adjustable;

a sensor configured to determine an orientation of said housing relative to a predetermined datum, wherein said predetermined datum is a gravitational field; and a controller operably connected between said sensor and said light source, wherein said controller is configured to automatically adjust the intensity of light emitted from said at least one light source based upon the determined orientation of said housing, wherein said at least one light source comprises a first light element and a second light element, and further wherein said first and second light elements are mounted on said housing at an angle with respect to each other.

2. The lighting unit of claim 1, further comprising a housing mount mounted on said housing.

3. The lighting unit of claim 1, further comprising a light source driver operably connected between said controller and said at least one light source.

4. The lighting unit of claim 1, wherein said sensor is an accelerometer.

5. The lighting unit of claim 1, wherein said sensor is an optical sensor or a magnetic sensor.

6. The lighting unit of claim 1, further comprising a heat sink mounted to said housing and operably connected to said at least one light source.

7. The lighting unit of claim 1, wherein each of said at least one light sources comprises an optical element.

8. The lighting unit of claim 1, wherein said at least one light source comprises one or more LEDs.

9. The lighting unit of claim 1, wherein said at least one light source comprises a two-dimensional array of LEDs.

10. A lighting fixture comprising:

a rail extending along a longitudinal axis; and a plurality of lighting units mounted to said rail for selective rotation about said longitudinal axis, wherein each of said plurality of lighting units comprises a housing, at least one light source, a sensor configured to determine an orientation of said housing relative to a predetermined datum, and a controller operably connected between said sensor and said light source, wherein said controller is configured to automatically adjust a predetermined property of at least one of said at least one light sources based upon the determined orientation of said lighting unit, wherein each of said plurality of lighting units is independently rotatable about said longitudinal axis.

11. The lighting fixture of claim 10, wherein each of said plurality of lighting units further comprises a light source driver operably connected between said controller and said at least one light source.

12. The lighting fixture of claim 10, wherein said sensor is an accelerometer.

13. The lighting fixture of claim 10, wherein said at least one light source comprises a first light source and a second light source, and further wherein said first and second light sources are mounted on said housing at an angle with respect to each other.

14. The lighting fixture of claim 10, wherein the intensity of light emitted by said first light source is stronger than the intensity of light emitted by said second light source when said housing is in a first orientation, and wherein the intensity of light emitted by said first light source is weaker than the intensity of light emitted by said second light source when said housing is in a second orientation.

15. The lighting fixture of claim 10, wherein said controller is further configured to automatically adjust a predetermined property of at least one of said at least one light source based upon the determined orientation of another lighting unit within said lighting fixture.

16. The lighting fixture of claim 15, wherein said at least one light source comprises one or more LEDs.

17. A method for creating a desired illumination pattern using a lighting fixture comprising a rail extending along a longitudinal axis and a plurality of lighting units mounted to said rail for independent rotation about said longitudinal axis, each of said plurality of lights comprising at least one light source, the method comprising the steps of: automatically determining a first orientation of at least one of said plurality of lighting units in response to rotation of said at least one of said plurality of lighting units; and automatically adjusting the intensity of light emitted from at least one light source of the rotated lighting units based upon the determined first orientation of said lighting units wherein each of said plurality of lighting units is independently rotatable about said longitudinal axis.

18. The method of claim 17, wherein said at least one light source comprises a first light source and a second light source, and further wherein said first and second light sources are mounted on said housing at an angle with respect to each other.

19. The method of claim 18, wherein the step of automatically adjusting the intensity of light emitted from at least one light source of rotated lighting units based upon the determined orientation of said lighting unit comprises the step of:

increasing the intensity of light emitted by said first light source and lowering the intensity of light emitted by said second light source when said rotated lighting units are rotated to said first orientation.

* * * * *